United States Patent [19]

Waller et al.

[11] Patent Number: 4,973,002

[45] Date of Patent: Nov. 27, 1990

[54] DEVICE FOR REDUCING FIBROUS PRODUCTS

[75] Inventors: Martin Waller; Geoffrey Farrell, both of Bolton; Kenneth Ward, Oakenshaw, Nr. Bradford, all of United Kingdom

[73] Assignee: Vernon & Company Limited, Great Britain

[21] Appl. No.: 367,527

[22] Filed: Jun. 16, 1989

[30] Foreign Application Priority Data

Jun. 16, 1988 [GB] United Kingdom ..... 8814326

[51] Int. Cl.[5] ..... B02C 23/36

[52] U.S. Cl. ..... 241/46 B; 241/46.17

[58] Field of Search ..... 241/199.12, 46 R, 46 A, 241/46.02, 46.04, 46.17, 282.1, 282.2

[56] References Cited

U.S. PATENT DOCUMENTS 2,616,340 11/1952 Knoll ..... 241/46 R
2,708,074 5/1955 Hoskins ..... 241/46 B X
2,731,208 1/1956 Dodd ..... 241/46 B X
3,510,000 5/1970 Carlson ..... 241/46.17 X
4,034,422 7/1977 Farber et al. ..... 241/46 A X

FOREIGN PATENT DOCUMENTS 1122361 1/1962 Fed. Rep. of Germany ... 241/46.17

*Primary Examiner*—Mark Rosenbaum
*Attorney, Agent, or Firm*—Dykema Gossett

[57] ABSTRACT

A macerator for reducing solid paper pulp products such as bedpans has a housing that is closable by a lid provided with an internal spray. An agitating blade is mounted to rotate within the housing about an axis of rotation inclined to a longitudinal axis of the housing. The agitating blade has two cutting edges inclined in different directions. High hydraulic shear between the agitating blade and the internal wall of the housing is produced on liquid within the housing. The axis of rotation may be offset from and may intersect the longitudinal axis of the housing.

21 Claims, 4 Drawing Sheets

87
78
74
72
16
76
124
100
98
94
126
122
25
24
25
24
48
51
38
116
50
128
114
118
110
42
62
108
112
96
TO 118
106
46
130
132
TO S
44
101
102
104

DEVICE FOR REDUCING FIBROUS PRODUCTS

DESCRIPTION

The present invention relates to devices for reducing fibrous products. In particular, but not exclusively, the invention relates to macerators for reducing soiled paper pulp pedpans, urine bottles and the like, to enable them to be discharged into a sewer.

One form of existing device, used mainly, but not exclusively, as a macerator, is in the form of a generally cylindrical, upright drum having a rotatable cutting blade disposed at the centre of its base, the blade being rotatable by means of an electric motor. An annular arrangement of teeth is disposed in the macerator, just below the level of the blade so that material which is first chopped roughly by the blade is subsequently ground into much smaller particles between the moving blade and the stationary cutting teeth. In use, an article to be macerated is placed in the container, and a lid closes off the aperture. During the operating cycle, water is fed continuously into the container and the motor is continuously operated. Particles are discharged from the container when they have been ground sufficiently to be able to pass through the gap between the moving blade and the stationary teeth.

Such a device has the disadvantages that the motor runs continuously throughout the cycle, and also that it may be possible for relatively large, elongate particles of material to pass through the said gap lengthways, and subsequently coalesce with other particles, thus causing a blockage in a drain to which the device is connected.

Another form of device is in the form of an elongate bath, generally U-shaped in cross-section, which has a rotatable shaft passing along the elongate axis of the bath, the shaft being provided with a plurality of knife blades. A housing is positioned beneath the said bath, and communicates therewith by means of a plurality of ¾" (1.9 cm) apertures. The housing is connected to a drain via a ball valve.

In use, an article to be macerated is placed in the bath, and a lid closes off its aperture. A fixed quantity of water is fed into the container, and the shaft is rotated, whereby the knife blades perform a chopping action on the contents. When the particles are smaller than ¾" (1.9 cm) they are able to pass through the said apertures, and are then discharged when the ball valve is opened.

However, it is possible for particles larger than ¾" (1.9 cm) to be discharged, if, for example, they pass lengthways through the apertures. Thus, the possibility of drain blockage is still present.

With the prior art devices, large particles can lead to blockages within the drainage system to which the devices are connected, and in the latter system such particles can also restrict correct operation of the outlet valve.

It is an object of the invention to provide a reducing device which reduces articles to the necessary size efficiently.

In accordance with a first aspect of the present invention, a device for reducing fibrous products comprises a housing for receiving the products to be reduced and agitating means rotatably mounted within the housing for reducing the products, the agitating means being located and/or orientated assymetrically within the housing.

In one embodiment, the housing comprises a generally cylindrical housing, and the axis of rotation of the agitating means is inclined to the longitudinal axis of the cylindrical housing. The axes of rotation of the housing and of the agitating means may or may not intersect.

Alternatively, or in addition, the agitating means is displaced or offset from the longitudinal axis of the cylindrical housing. This results in a high hydraulic shear between the agitating mean and the wall of the housing. In one embodiment, the agitating means is in the form of a rotatable blade which is closely spaced from the wall of the housing.

Preferably, the device is arranged with the longitudinal axis of the cylindrical housing disposed vertically. The upper end of the housing may be provided with a closable lid. The lid may be provided with a water spray for spraying water into the housing, and is preferably provided with an outlet valve for discharging reduced articles.

It is a further object of the present invention to provide an improved valve, and in particular, but not exclusively, a valve which is suitable for use with a device for reducing fibrous products.

In accordance with a second aspect of the present invention, there is provided a valve comprising a valve housing, a valve seat, a valve closure member within the housing comprising a relatively rigid sealing portion adapted to engage sealingly with the valve seat and a flexible diaphragm portion disposed around the periphery of the sealing portion, the diaphragm portion sealingly abutting a portion of the valve housing to define a pressure chamber between the valve closure member and the valve housing, and a part for applying fluid pressure to the chamber in order to urge the sealing portion into engagement with the valve seat.

Such a valve produces a positive sealing action, and is particularly useful as an exit valve for a device as hereinbefore described. Macerators are usually supplied with pressurised water which is sprayed into the device and which now may also be used to actuate the valve.

Also, the water used to actuate the valve is subsequently discharged into the device during later operation.

Also, the valve as described above has excellent characteristics. Firstly, if a non-reducable item is accidentally placed in the device and lodges between the valve closure member and the valve seat, then although the valve closure member is still urged towards a closed position, it is not dangerous, since a set water pressure is applied to the valve closure member. In contrast, with a solenoid operated valve an overload might occur as the solenoid tried to close the valve closure member. Also, the valve is self-aligning, with the result that closure of the valve closure member is still permitted in many circumstances if particles are trapped between it and the valve seat. The valve closure member can form around the particles deposited.

Preferably, therefore, the valve is actuated by means of pressurised fluid, e.g. water, which is fed to the device to which the valve is connected.

Preferably, the valve further comprises biassing means to bias the valve closure member against the force of applied fluid. The biassing means may comprise resiliently deformable means, such as a spring. In one embodiment, the spring is a tension spring.

The valve seat preferably defines an exit aperture.

The invention also includes a device for reducing fibrous articles when fitted with a valve in accordance with the present invention, and in particular it includes a macerator when fitted with a valve in accordance with the present invention.

By way of example only, a specific embodiment of the present invention will now be described, with reference to the accompanying drawings, in which.

Figure 1:
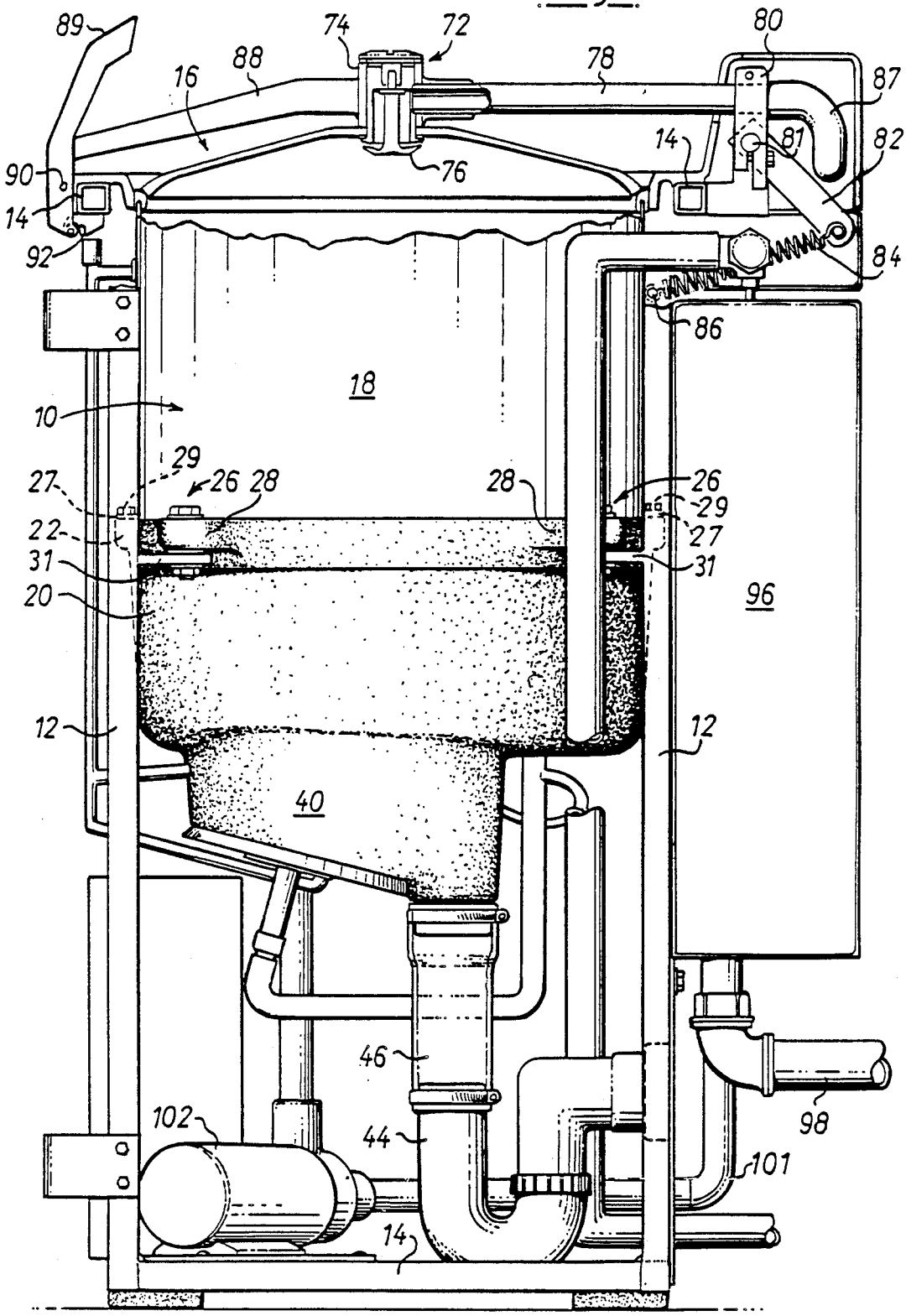
FIG. 1 is a side view of an embodiment of reducing device in accordance with the present invention.

Referring to FIGS. 1 to 4, the device comprises a stainless steel drum 10 supported on a framework having four vertical legs 12 (only two of which are visible in FIG. 1) arranged in square formation and eight cross-members 14 interconnecting the upper ends and the lower ends of the legs 12. The upper end of the drum is open, and is provided with a closable lid 16.

The drum is in the form of upper and lower portions 18,20, each being generally cylindrical internally. The lower edge of the upper portion 18 is received on a peripheral rim 22 on the upper edge of the lower portion 20, the two portions being sealed by an annular seal 24 between the upper portion 18 and the rim 22. The upper and lower portions are releasably secured together by means of a seal locating ring 25 which sits on top of the seal 24 and is held in position by a plurality of plates 27 which are releasably connectible to the lower portion 20 by means of bolts 29 passing through the plates 27 and a lug 28 of the lower portion, thereby compressing the seal 25. The drum is mounted on the frame by means of lugs 31 attached to the upright legs 12 and by bolt and nut combinations 26 passing through the lugs and the lug 28.

The lower end of the lower drum portion 20 is closed off by a base having a gently downwardly sloping, generally frusto-conical portion 30 whose plane is normal to the longitudinal axis of the drum, the planar portion being contiguous with an inclined planar portion 32, inclined at an angle of 30° to the horizontal. The portion 30 is also provided with a circular exit aperture 36 at its base. The circular aperture may be closed off by means of a diaphragm valve 38 in a valve housing 40 beneath the aperture, and when the valve is open the aperture 36 communicates with a further aperture 42 in the base of the valve housing. The valve housing 40 is connected via the aperture 42 to an outlet pipe 44, the first part 46 of which is transparent to enable the flow of pulp to be seen. The pipe 44 is formed into a U-bend downstream from the transparent portion.

Figure 2:
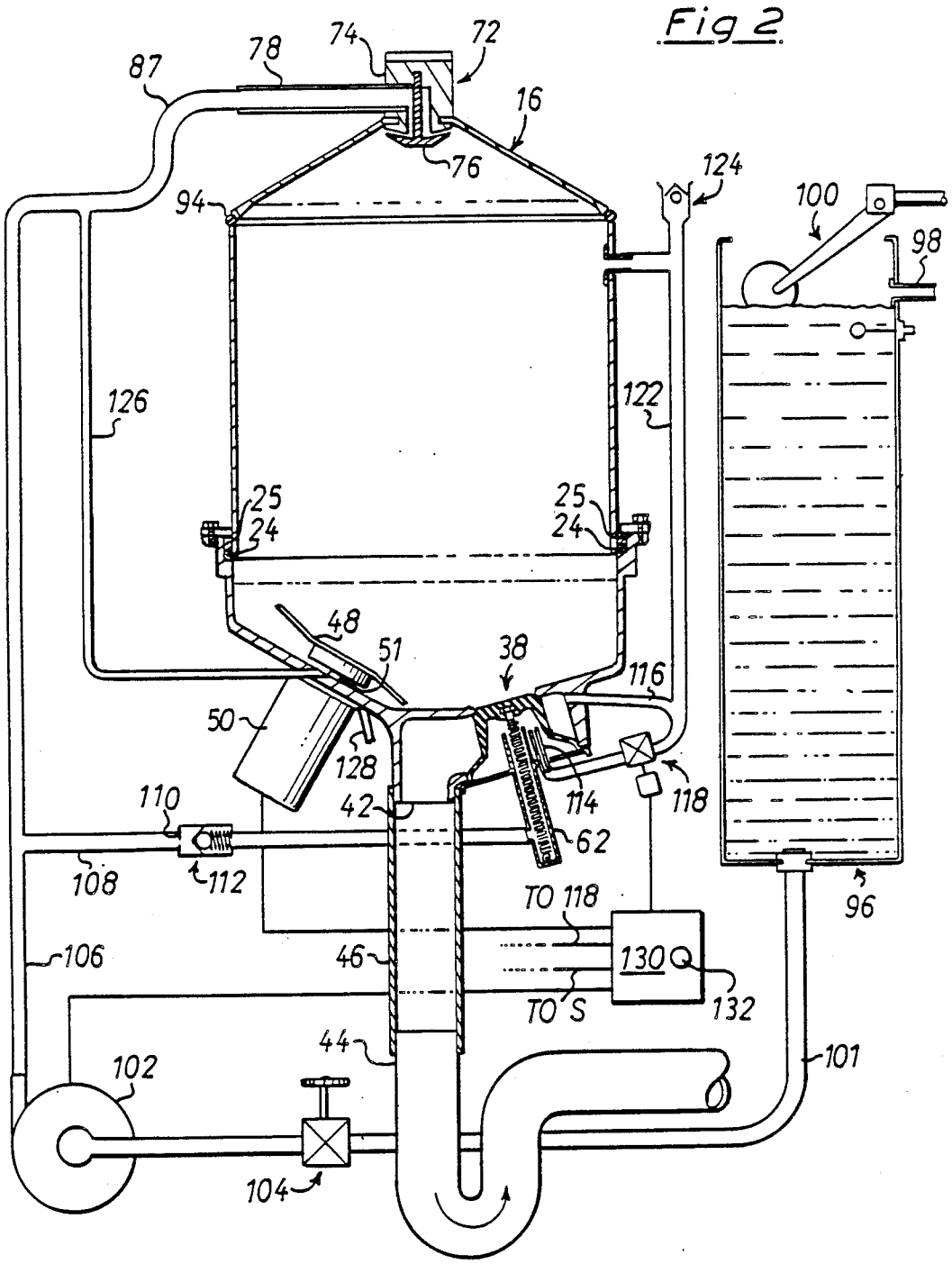
FIG. 2 is a schematic cross-section of the device of FIG. 1, also showing the connections between the various components.

The inclined planar portion 32 is provided with a rotatably mounted blade 48 which is rotatable by means of an electric motor 50 whose output shaft 51 passes sealingly through an aperture in the portion 32. As best seen in FIG. 2, the blade 48 is not symmetrical, but comprises two portions, one on either side of the rotational axis, one inclined upwardly and the other inclined downwardly. The axis of rotation of the motor and of the blade is normal to the plane of the inclined portion 32, i.e. is inclined to the longitudinal axis of the drum 10. Moreover, the blade 48 and its rotational axis are offset laterally from the longitudinal axis of the drum. It should also be noted that the longitudinal axis of the drum, the rotational axis of the motor and the centre of the circular aperture 36 are not aligned, and that the rotational axis of the blade 48 does not intersect the longitudinal axis of the drum.

Figure 4:
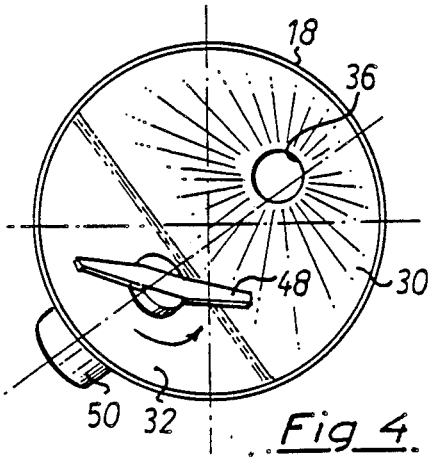

It is also noted that the closest separation of the blade and the interior of the drum is about ½" (1.27 cm), which has an important effect on the articles to be reduced, since the small separation causes a large hydraulic shear on particles passing therethrough. It is also important that after the closest separation of the blade and the drum, the sense of rotation of the blade is such that the material flows down the sloping portion 32 as opposed to up the sloping portion. This is achieved by rotating the blade anti-clockwise as seen in FIG. 4, and produces a more effective reducing action, although the device will still work, albeit less effectively, with clockwise rotation of the blade.

Figure 5:
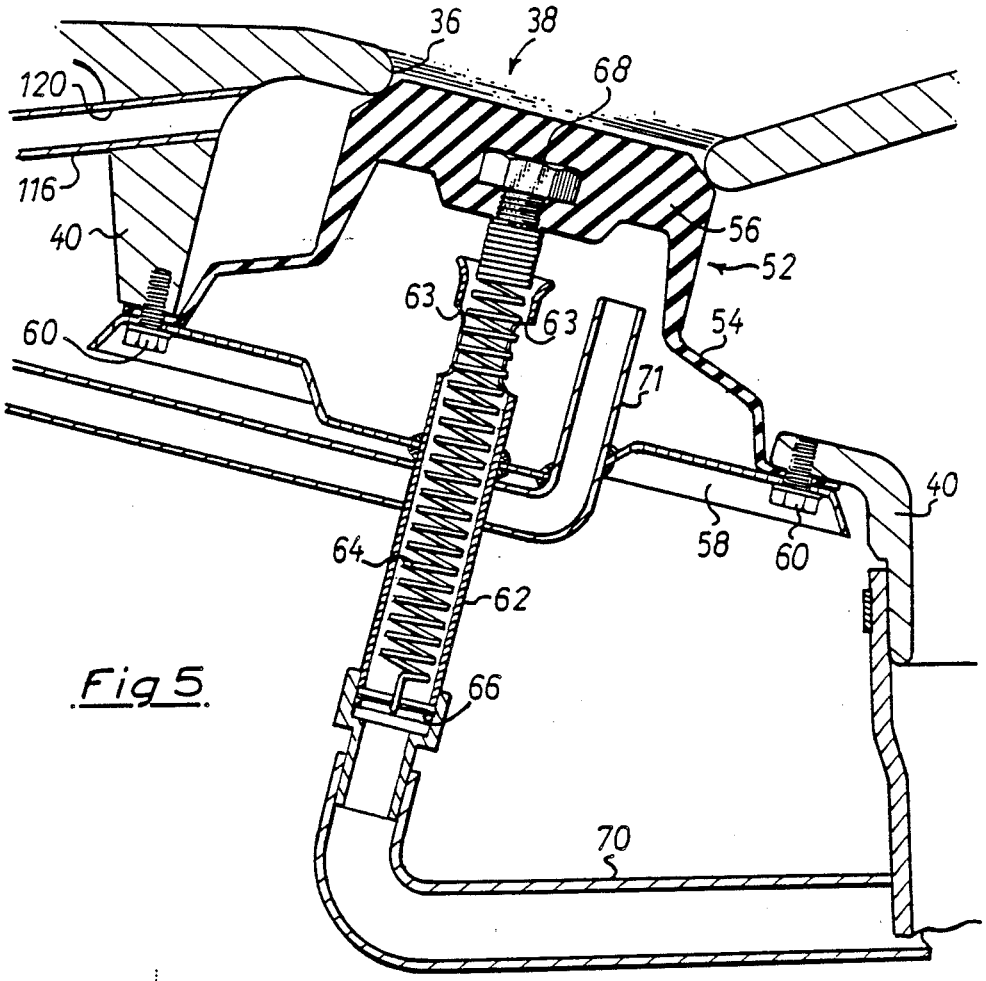
FIG. 5 is a detail cross-section of an embodiment of valve in accordance with the present invention, used on the device of FIG. 1.
Figure 3:
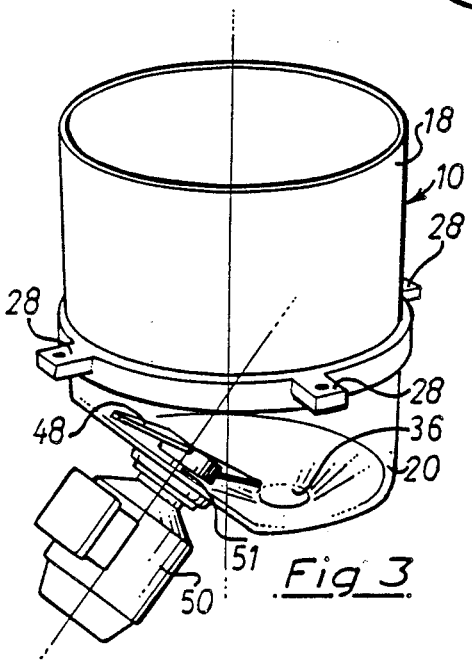
FIGS. 3 and 4 are perspective and plan views respectively of a portion of the device of FIG. 1, showing the positioning and orientation of certain components of the device.

The diaphragm valve 38 is illustrated in more detail in FIG. 5. The valve comprises a valve housing 40, formed integrally with the lower drum portion 20, and a valve closure member 52. The valve closure member is moulded from a single piece of polyurethane and comprises a flexible, peripheral, dished, stepped diaphragm portion 54 and a central, plug portion 56. The peripheral edge of the plug portion 56 is chamfered to provide a shoulder which can engage sealingly with a valve seat formed by the material defining the aperture 36. The valve housing also comprises a rigid metal cover plate 58, which is positioned sealingly over the undersurface of the integrally formed portion of the valve closure member by means of securing bolts 60 which pass through the cover plate 58 and the periphery of the diaphragm and are received in threaded bores in the integrally formed portion of the valve housing.

A metal tube 62 passes through, and is secured to, the diaphragm cover plate 58. Ports 63 are provided in the tube, within the housing cover plate 58. One end of a tension spring 64 is secured to the lower end of the tube by means of a collar 66 secured therein. The other end of the spring is secured to the shaft of a bolt 68 whose head is embedded in the plug portion 56 of the valve closure member. The tension spring biasses the plug portion 56 out of engagement with the valve seat, but the movement of the diaphragm is limited by the upper end of the tube 62 which abuts the undersurface of the plug portion after the plug portion has moved a short distance out of engagement with the valve seat to open the valve. The opposite end of the tube 62 is connected to a water supply pipe 70 in order that the valve may be closed by means of water pressure acting on the undersurface of the valve closure member, as will be explained hereinafter. An air relief tube 71 which allows the valve to open, as will be explained, also passes sealingly through the housing cover plate 58.

The upper end of the drum 10 is closable by means of a circular domed lid 16. The lid is provided with a spray head 72 in its centre, which comprises a housing 74 and a poppet 76 which is screw-threadedly received in the housing 74. A gap is left between the head of the poppet and the housing, and water entering the housing through a supply pipe 78 is expelled through the gap in the form of a continuous cylindrical curtain. The supply pipe is secured to the spray head housing 74 and is used to pivotally mount the lid 16. The end of the pipe 78 remote from the spray head is provided with a lug 80 which is used to mount the pipe 78 on a pivot 81. A bar 82 is mounted on the pivot 81 at one end and is movable with the pipe 78 and lid 16. The other end of the bar 82 is attached to one end of a tension spring 84, the other end of which is connected to a further mounting lug 86 which is secured to a frame member 12. The spring urges the lid towards its opened position. The pipe 78 is supplied with water by means of a hose 87.

A metal bar 88 extends from the spray head 72 on the opposite side from the pipe 78, and the end of the bar 88 remote from the spray head is provided with an opening handle 89 which is pivotable about a pivot 90, by means of which the handle can be hooked under a corresponding recess member 92 attached to the frame, into a securing position in which the periphery of the lid is held sealingly against an annular seal 94 extending around the upper peripheral edge of the drum 16.

Figure 6:
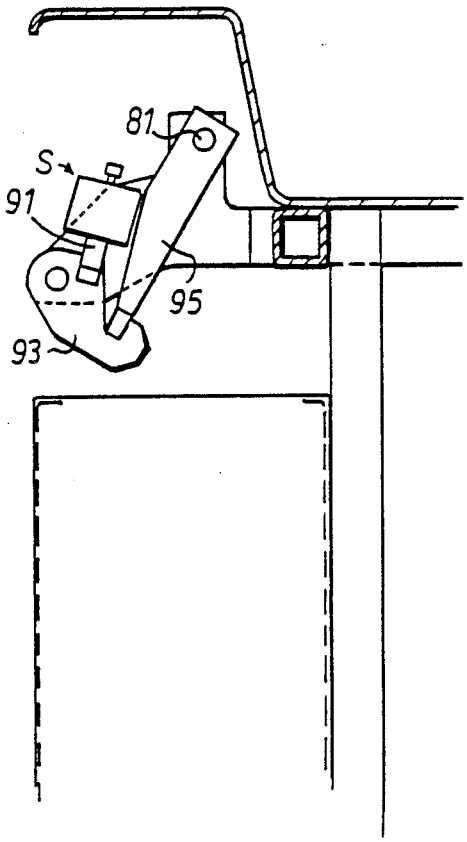
FIG. 6 is a side view of a lid lock arrangement of the device of FIG. 1.

The lid is also provided with a lid lock, illustrated in FIG. 6, which is a view of the lid hinge region from the opposite side of the device than shown in FIG. 1. The lock comprises a solenoid S having a plunger 91 which is engageable in a recess in a spring loaded pawl 93 which is pivotally mounted to the frame of the device and gravity-biassed in the clockwise direction as shown in FIG. 6. The pawl is engageable with a finger 95 which is rigidly connected to the lid and which pivots with it about pivot 81. The solenoid S is shown in FIG. 6 in its actuated state in which the plunger 91 is withdrawn, permitting the pawl 93 to engage with the finger 95, and preventing the lid from opening. Upon deengergisation of the solenoid S, the plunger projects downwardly as shown in FIG. 6 and causes the pawl 93 to move against its spring bias out of engagement with the finger 95, allowing the lid to be opened.

A water cistern 96 is provided at the rear of the device, mounted on the frame. The cistern has a capacity of thirty-two liters and is fed from a conventional float valve inlet 100. An overflow pipe 98 is also provided. The cistern feeds water via a tube 101 to a Stuart Turner 12 Mk.3 electric water pump 102 via a stop valve 104. The pump 102 feeds water via a 22 mm diameter clear plastics hose 106 to the hose 87 and then to the pipe 78 and the spray head 72.

A further tube 108 branches from the tube 106 and is connected via a restrictor 110 and a non-return valve 112 to the tube 62 extending out of the valve housing 40. The air relief tube 71 also extends out of the valve cover plate 58 and is connected to the opposite side of the valve closure diaphragm 52 by means of a tube 116 via a solenoid valve 118, the tube 116 co-operating with a passage 120 in the valve housing. A further tube 122 branches from the tube 116, and is connected to the drum near its upper edge, and also to a non-return valve 124.

A further tube 126 branches from the tube 106, and supplies water to the region of the seal of the motor against the drum. The seal between the motor and the drum is a conventional ceramic seal, and as with conventional ceramic seals, a flow of pressurised water is provided to prevent debris from fouling the seal. By keeping the pressure of the water fed to the seal higher than that in the drum, any flow which occurs will be outward from the seal into the drum. An outlet tube 128 from the motor 50 is provided, and communicates with the valve housing 40, thereby disposing of any fluid which manages to seep past the seal.

The device is under the control of a control unit, illustrated schematically by 130, and operated by a push button 132. The control unit comprises a plurality of cam-operated switches which act to actuate different functions of the device in a pre-set sequence, as will be explained. Each function is controlled by a respective cam mounted on a common axle which rotates once per disposal cycle.

In use, an article to be reduced is placed inside the drum and the lid is closed. Due to the inclined portion 32 of the base, the article does not lie flat on the base, but usually assumes an inclined orientation permitting the blade to contact the article at more than one location The push button is depressed, and immediately the lid lock solenoid is actuated by the control unit, thus preventing access to the interior of the drum until the end of the cycle. One and a half seconds later, the control unit actuates the pump 102, and the pressure of water opens the non-return valve 112. The control unit also closes the solenoid valve 118. In this way, water is fed to the chamber defined by the valve closure member 52, the integrally formed valve housing 40 and the valve closure plate 58, thereby urging the sealing portion 56 of the valve closure member 52 into sealing abutment with the valve seat against the force of the valve spring 64. Water is also fed into the drum 10 through the valve spray head 72.

The pump is actuated for a period of thirteen and a half seconds, which permits twelve liters of water to be pumped into the drum. As the pump is stopped by the control unit, the non-return valve 112 shuts, which severs the connection between the pump 102 and the valve 38. The shut non-return valve 112 thus ensures that the water pressure in the valve 38 is maintained when the pump is turned off, thereby keeping the valve 38 closed.

One second before the pump is stopped, the control unit actuates the cutter motor 50, thereby causing the blades 48 to rotate rapidly and reduce the contents of the device to a slurry with the water fed in by the pump. Since the cutter blade is arranged assymetrically in the drum (it is offset from the central axis of the drum, its rotational axis is inclined to the longitudinal axis of the drum and the two axes do not intersect) the cutting action produced by the blade 48 tends to be irregular, thus reducing or removing any regions of constant low velocity in the drum, preventing or significantly reducing the deposition of particles on the interior of the drum. The irregular action is increased by the fact that one portion of the blade 48 is upwardly inclined and the other one downwardly inclined. It is believed that, after initial disintegration of the articles to be disposed into relatively large particles, the subsequent reduction in size of the particles is effected mainly by fluid pressure and turbulence produced by the motion of the blade rather than by interaction of the particles with the blade itself.

This effect results particularly from the fact that the blade comes sufficiently close to the interior of the drum, to impart a large hydraulic shearing force on the particles to be reduced, in this particular case ½" (1.27 cm), although this distance may be varied. Moreover, since the blade rotates clockwise as seen in FIG. 4, the reduced particles are forced down the inclined portion 32 after the closest separation, further improving the reducing action.

Figure 7:
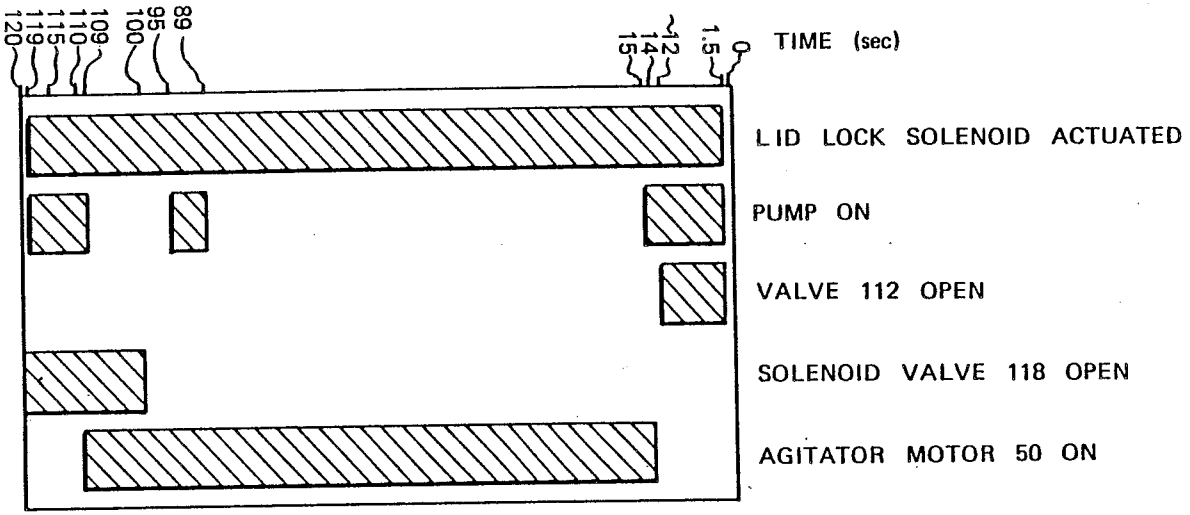
FIG. 7 is an illustration showing the operation of the device of FIG. 1.

The pump 102 is actuated again eighty-nine seconds after the start of the cycle, for a further period of six seconds allowing the ingress of a further ten liters of water through the spray 72. However, five seconds after the end of the second actuation of the pump, the control unit opens the solenoid valve 118, thereby releasing the pressurised fluid held in the valve 38 through pipe 116 onto the other side of the valve closure diaphragm 54, thereby causing the valve spring 64 to open the valve 38. The motor 50 is stopped after one hundred and ten seconds. A further ten liters of water is added at one hundred and nine seconds as a rinse, and the lid lock solenoids is de-actuated after one hundred and nineteen seconds, allowing the lid to be opened. The reduced contents are thus allowed to flow to drain, and the interior of the drum has been rinsed clean. A summary of the operating cycle is given below and is illustrated in FIG. 7.

| Time Elapsed(s) | |
|---|---|
| 0 | (a) Pushbutton 132 depressed;<br>(b) Lid lock solenoid actuated. |
| 1.5 | (a) pump 102 started;<br>(b) Non-return valve 112 is opened by water pressure;<br>(c) Solenoid valve 118 shuts. |
| 14 | Cutter motor 50 starts. |
| 16 | (a) Pump 102 stops (12 l in drum)<br>(b) Non-return valve 112 shuts |
| 89 | (a) Pump 102 starts<br>(b) Non-return valve 112 is opened by water pressure |
| 95 | (a) Pump 102 stops (extra 6 l inserted)<br>(b) Non-return valve 112. |
| 100 | Solenoid valve 118 opens - valve 38 allowed to open |
| 109 | Pump 102 starts |
| 110 | Cutter motor stops |
| 119 | (a) Pump stops (10 l water added)<br>(b) Lid lock solenoid de-actuated |
| 120 | Cycle finishes. |

The operation of only one particular cycle has been described. However, many other different cycles can be utilised as required, depending, for example, on the type of material to be reduced. For example, the operation may be different for disposal of food waste such as in a house, or animal waste such as in a chicken hatchery.

We claim:

1. A macerator comprising:

a housing, the housing having a longitudinal axis and the housing comprising an upper portion, said upper portion having at least one interior wall disposed generally symmetrically about said longitudinal axis, a bottom portion, said bottom portion having an inclined wall sloping downwardly, generally toward said longitudinal axis and said bottom portion having a frusto-conical base adjacent to and below said inclined wall;

an opening in said housing allowing articles to be fed into said housing;

an outlet from the housing for macerated articles, said frusto-conical base leading to said outlet; and an agitating means mounted for rotation within said housing for inducing maceration of articles fed into said housing, said agitating means being rotatable above said inclined wall.

2. A macerator as claimed in claim 1, wherein said inclined wall portion is generally planar.

3. A macerator as claimed in claim 2, wherein the rotational axis of said agitating means is substantially normal to the plane of the inclined wall portion.

4. A macerator as claimed in claim 1, wherein said agitating means is mounted on said inclined wall.

5. A macerator as claimed in claim 1, further comprising closure means for releasably closing said outlet.

6. A macerator as claimed in claim 5, wherein said outlet closure means comprises a valve.

7. A macerator as claimed in claim 1, further comprising means for feeding water into the housing.

8. A macerator as claimed in claim 7, wherein said water feeding means comprises a water spray.

9. A macerator as claimed in claim 8, wherein said spray is located on said closure for releasably closing said opening in said housing.

10. A macerator as claimed in claim 1, wherein said closure is hingedly mounted.

11. A macerator as claimed in claim 1, wherein said opening in said housing is located in the upper region of the macerator.

12. A macerator as claimed in claim 1, wherein, in use, the rotational axis of said agitating means is inclined to the vertical.

13. A macerator as claimed in claim 1, wherein the axis of rotation of said agitating means does not intersect with the longitudinal axis of said cylindrical portion.

14. A macerator as claimed in claim 1, wherein the axis of rotation of said agitating means intersects with the longitudinal axis of said cylindrical portion.

15. A macerator as claimed in claim 1, wherein the longitudinal axis is the axis of said upper, generally symmetrical upper portion of said housing, the axis of said upper, generally symmetrical upper portion of said housing, in use, being disposed substantially vertical.

16. A macerator as claimed in claim 1, wherein the longitudinal axis is the axis of said upper, generally symmetrical upper portion of said housing and said agitating means is offset from said axis of said upper, generally symmetrical upper portion of said housing.

17. A macerator as claimed in claim 1, wherein said agitating means comprises a rotatable blade.

18. A macerator as claimed in claim 17, wherein said blade comprises two cutting edges.

19. A macerator as claimed in claim 18, wherein said two cutting edges are inclined in different directions to the rotational axis of said blade.

20. A macerator as claimed in claim 17, wherein the shortest distance between said agitating means and the internal wall of said housing is sufficiently small for rotation of said blade to induce hydraulic shearing forces in liquids disposed within the housing.

21. A macerator as claimed in claim 1, wherein said upper portion is generally cylindrical.

* * * * *

UNITED STATES PATENT AND TRADEMARK OFFICE

CERTIFICATE OF CORRECTION

PATENT NO. :4,973,002
DATED :November 27, 1990
INVENTOR(S) :Martin Waller, et. al.

It is certified that error appears in the above-indentified patent and that said Letters Patent is hereby corrected as shown below:

Column 7, after line 57, insert the following:

--a releasably securable closure for releasably closing said opening in said housing;--.

Signed and Sealed this

Twenty-first Day of December, 1993

*Attest:*

Bruce Lehman

BRUCE LEHMAN

*Attesting Officer*

*Commissioner of Patents and Trademarks*